US011657693B2

(12) United States Patent
Solis Vidal

(10) Patent No.: US 11,657,693 B2
(45) Date of Patent: May 23, 2023

(54) FIRE DETECTION FOR DIRTY ENVIRONMENTS

(71) Applicant: Carrier Corporation, Palm Beach Gardens, FL (US)

(72) Inventor: Pablo Solis Vidal, Barcelona (ES)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 17/520,867

(22) Filed: Nov. 8, 2021

(65) Prior Publication Data

US 2022/0172591 A1 Jun. 2, 2022

(51) Int. Cl.
*G08B 17/117* (2006.01)
*A62C 3/00* (2006.01)
*G08B 21/18* (2006.01)

(52) U.S. Cl.
CPC ..... *G08B 17/117* (2013.01); *A62C 3/00* (2013.01); *G08B 21/182* (2013.01)

(58) Field of Classification Search
CPC .... G08B 17/117; G08B 21/182; G08B 17/10; A62C 3/00
See application file for complete search history.

(56) References Cited

U.S. PATENT DOCUMENTS 5,767,776 A 6/1998 Wong
8,077,046 B1 12/2011 Wong
8,947,243 B2 2/2015 Erdtmann
2003/0069002 A1* 4/2003 Hunter ..... G08B 25/016 455/567
2013/0271286 A1* 10/2013 Quan ..... H04Q 9/00 340/691.6
2017/0084160 A1* 3/2017 Piccolo, III ..... G08B 25/001
2018/0158313 A1* 6/2018 Meah ..... G08B 29/24
2020/0051414 A1* 2/2020 Kim ..... G08B 21/02
2020/0242916 A1* 7/2020 Krstanovic ..... G08B 21/0453

FOREIGN PATENT DOCUMENTS

KR 101863100 B1 5/2018
KR 102054935 B1 12/2019

OTHER PUBLICATIONS

European Search Report for Application No. 20383048.4, dated May 11, 2021, 8 pages.

* cited by examiner

*Primary Examiner* — Ojiako K Nwugo
(74) *Attorney, Agent, or Firm* — Cantor Colburn LLP

(57) ABSTRACT

A fire detector for monitoring an environment and a method of operating a fire detector including a smoke sensor and a volatile organic compound, VOC, sensor are described. A fire detector 10 for monitoring an environment 20 includes a smoke sensor 12 and a volatile organic compound, VOC, sensor 14, the fire detector 10 is configured to adjust a smoke sensitivity of the fire detector 10 based on a VOC concentration detected by the VOC sensor 14. The smoke sensitivity is decreased when increased VOC concentrations are detected.

14 Claims, 1 Drawing Sheet

20

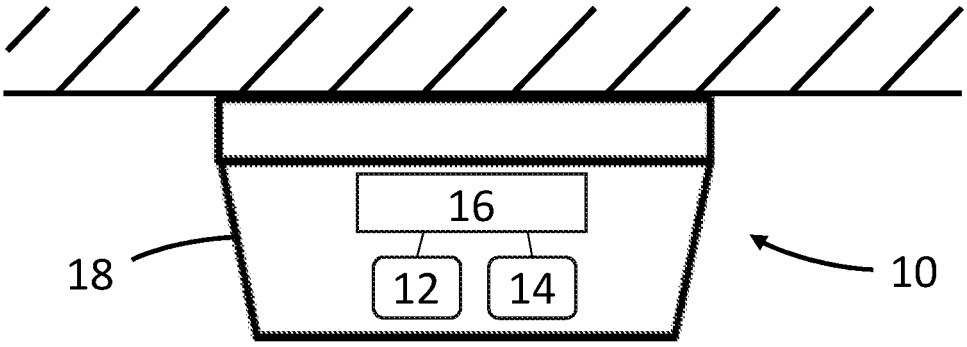
20

FIRE DETECTION FOR DIRTY ENVIRONMENTS

FOREIGN PRIORITY

This application claims priority to European Patent Application No. 20383048.4, filed Dec. 2, 2020, and all the benefits accruing therefrom under 35 U.S.C. § 119, the contents of which in its entirety are herein incorporated by reference.

TECHNICAL FIELD

The present invention relates to fire detection, and particularly to fire detection suitable for use in a dirty environment.

BACKGROUND

Fire detection is commonly based on detection of smoke particles suspended in the air, for example by detecting light scattered caused by the smoke particles. However, this type of detection is most effective in a "clean" environment, such as office spaces and the like. In a "dirty" environment, such as warehouses, factories, automotive parking facilities and the like, many other types of particles can be found suspended in the air. These particles can result in false fire alarms, which are disruptive and in some cases costly.

A need therefore exists for improved fire detection suitable for use in dirty environments.

SUMMARY

Viewed from a first aspect, the present invention provides a fire detector for monitoring an environment, the fire detector comprising a smoke sensor and a volatile organic compound (VOC) sensor, wherein the fire detector is configured to adjust a smoke sensitivity of the fire detector based on a VOC concentration detected by the VOC sensor.

Volatile organic compounds (VOCs) are organic chemical compounds based on carbon chains or carbon rings having a relatively high vapour pressure (e.g. above 0.01 kPa) at ordinary room temperature (e.g. 20° C.).

For example, EU Council Directive 1999/13/EC defines the term VOC as meaning any compound containing at least the element carbon and one or more of hydrogen, halogens, oxygen, sulphur, phosphorus, silicon or nitrogen, with the exception of carbon oxides and inorganic carbonates and bicarbonates, and having at 293.15° K a vapour pressure of 0.01 kPa or more, or having a corresponding volatility under the particular conditions of use.

As a consequence of their high vapour pressure, a large numbers of molecules of these compounds evaporate or sublimate from the liquid or solid form of the compound and enter the surrounding air.

The inventor has recognised that the presence of VOCs in the air is often closely correlated to the presence of other particles in the air. For example, a common source of non-fire smoke is automotive emissions. Such emissions can trigger a false fire alarm, as they contain smoke from non-combusted fuel. By adjusting the smoke sensitivity when VOCs are detected in the air, it is possible to reduce the occurrence of such false alarms without compromising the effectiveness of the fire detection in other situations.

Preferably the smoke sensitivity is decreased when a high VOC concentration is detected by the VOC sensor, for example relative to a higher sensitivity when a comparatively low VOC concentration is detected by the VOC sensor.

The fire detector may be configured to take an action responsive to detection of a concentration of smoke exceeding a smoke threshold. The smoke threshold may be determined as a function of the VOC concentration detected by the VOC sensor.

In one embodiment, the fire detector may be configured such that a first, lower smoke threshold is used when a VOC concentration detected by the VOC sensor is below a first VOC threshold, and a second, higher smoke threshold is used when the VOC concentration detected by the VOC sensor is above the first VOC threshold.

Optionally the fire detector may be configured use three or more smoke thresholds, wherein the smoke threshold used is selected based on the VOC concentration detected by the VOC sensor. For example, the fire detector may be configured to use a third smoke threshold, which is higher than the second smoke threshold, when the VOC concentration detected by the VOC sensor is above a second VOC threshold, which is higher than the first VOC threshold.

The action may comprise triggering a perceivable alarm, such as an audible or visible alarm. Such alarms may serve to alert occupants of the need to evacuate. The alarm may be integral with the fire detector, or may be provided as a separate component.

Additionally, or alternatively, the action may comprise triggering an auxiliary system, for example that is separate from the fire detector. The auxiliary system may comprise a fire protection system and/or a fire suppression system, optionally wherein the system is associated with the environment monitored by the fire detection system. Exemplary fire protection systems may comprise fire door or fire barrier release systems or other systems designed to inhibit progress of a fire. Exemplary fire suppression systems may include wet or dry sprinkler systems, or gaseous fire suppression systems.

The action may comprise sending a notification to an external recipient, such as to a system operator and/or to a fire service provider, or another appropriate emergency service provider.

The action may comprise sending an alert to a central fire monitoring system, such as a fire control panel. A fire control panel is a device for monitoring data from a plurality of fire detection systems, and is usually located in a central location within a building. The fire control panel may optionally be configured to control a fire protection system and/or a fire suppression system, such as those discussed above, and/or to send a notification to an external recipient.

The fire detector may communicate with any of the alarm, the auxiliary system, external recipient or the fire monitoring system by any suitable means, such as including by a wired interface or a wireless interface.

In a preferred embodiment, the present invention may provide a fire response system comprising the fire detector described above and a fire control panel in communication with the fire detector. Optionally, the fire response system may comprise a plurality of further fire detectors, each of which may be in communication with the fire control panel. Optionally, the fire response system may comprise one or more of the alarm, the fire protection system and the fire suppression system described above.

The VOC concentration is preferably a total VOC concentration, i.e. the total, combined concentration of substantially all VOCs present within a sample.

The VOC sensor may comprise a multi-gas sensor, which may for example be configured to detect a concentration of one or more further components in a sample of air, i.e. in addition to VOCs. The further components may comprise PM2.5 particles, CO2 gas and H2 gas. The VOC sensor may comprise a metal oxide (MOx) gas sensor.

In some embodiments, the VOC sensor may be configured to detect a concentration of smoke. The fire detector may be configured to determine a concentration of the smoke based on either or both of the VOC sensor and the smoke sensor.

The fire detector may be configured to send environmental data to an external system, wherein the environmental data comprises the VOC concentration measured using the VOC sensor. The environmental data may comprise concentration data for the one or more further components, such as PM2.5 particles, CO2 gas and H2 gas. This environmental data may be used to track the quality of the air in the monitored environment.

The smoke sensor is preferably an optical smoke sensor. The smoke sensor may comprise a detection chamber, a light source and a light detector. The smoke sensor may operate on a light scattering principle. For example, the light source may be configured to emit light into the detection chamber and the light detector may be configured to detect light scattered by the smoke. The light detector is preferably configured so as not to detect light from the light source when no smoke is present within the detection chamber.

The monitored environment may be a specifically delineated space, such as a particular room within a building. However, in some instances, the monitored environment may not be specifically delineated, and may be an unbounded space. For example, the fire detector may monitor only part of a space within a room and proximate the fire detector, where that part is not specifically delineated from the rest of the space.

The fire detector preferably comprises a local controller configured to control operation of the fire detector. The local controller may be in communication with each of the smoke sensor and the VOC sensor. The local controller may be configured to perform any of the processes described above. Whilst the local controller is preferably configured to locally determine the presence of a fire based on sensor data received from the smoke sensor and the VOC sensor, in some embodiments, the fire detector may not perform this function locally and may instead be configured to transmit the sensor data from the smoke sensor and the VOC sensor to a separate control system, such as the fire control panel. The fire control panel may therefore be configured to perform any necessary processing and to take any of the actions described above.

The fire detector may be a point detector. For example, the fire detector may be provided in or otherwise exposed to the monitored environment, and the fire detector may be configured to utilise ambient air movement to supply a sample of air to the smoke sensor and the VOC sensor. The fire detector may comprise a housing containing the smoke sensor and the VOC sensor. The fire detector may be provided within an optical labyrinth defined by the house.

Alternatively, the fire detector may comprise an aspirating detector. For example, the fire detector may comprise an aspirator to draw a sample of air from the monitored environment to the smoke sensor and the VOC sensor, such as via sampling tubes exposed to the monitored environment. The fire detector may be provided within the monitored environment, or elsewhere within the building.

Viewed from a second aspect, the present invention provides a method of operating a fire detector comprising a smoke sensor and a volatile organic compound (VOC) sensor, the method comprising: monitoring a concentration of VOCs within an environment using the VOC sensor; and adjusting a smoke sensitivity of the fire detector based on the VOC concentration.

The method may be performed using the fire detector described above, and may optionally include any one or more of the features described thereof.

Preferably the smoke sensitivity is decreased when a high VOC concentration is detected by the VOC sensor, for example relative to a higher sensitivity when a comparatively low VOC concentration is detected by the VOC sensor.

The method may comprise taking an action responsive to detection of a concentration of smoke exceeding a smoke threshold. The smoke threshold may be determined as a function of the VOC concentration detected by the VOC sensor.

The method may comprise using a first, lower smoke threshold as the smoke threshold when a VOC concentration detected by the VOC sensor is below a first VOC threshold, and using a second, higher smoke threshold as the smoke threshold when the VOC concentration detected by the VOC sensor is above the first VOC threshold. The method may further comprise using a third smoke threshold, which is higher than the second smoke threshold, as the smoke threshold when the VOC concentration detected by the VOC sensor is above a second VOC threshold, which is higher than the first VOC threshold.

The action may comprise triggering a perceivable alarm, such as an audible or visible alarm.

Additionally, or alternatively, the action may comprise triggering an auxiliary system, for example that is separate from the fire detector. The auxiliary system may comprise a fire protection system and/or a fire suppression system, optionally wherein the system is associated with the environment monitored by the fire detection system.

The action may comprise sending a notification to an external recipient, such as to a system operator and/or to a fire service provider, or another appropriate emergency service provider.

The action may comprise sending an alert to a central fire monitoring system, such as a fire control panel.

The VOC concentration is preferably a total VOC concentration.

The VOC sensor may comprise a multi-gas sensor, which may for example be configured to detect a concentration of one or more further components in a sample of air, i.e. in addition to VOCs. The further components may comprise PM2.5 particles, CO2 gas and H2 gas. The VOC sensor may comprise a metal oxide (MOx) gas sensor.

In some embodiments, the VOC sensor may be configured to detect a concentration of smoke. The concentration of smoke may be determined by either or both of the VOC sensor and the smoke sensor.

The method may comprise sending environmental data to an external system, wherein the environmental data comprises the VOC concentration measured using the VOC sensor. The environmental data may comprise concentration data for the one or more further components, such as PM2.5 particles, CO2 gas and H2 gas.

The smoke sensor is preferably an optical smoke sensor. The smoke sensor may comprise a detection chamber, a light source and a light detector. The smoke sensor may operate on a light scattering principle. For example, the light source may be configured to emit light into the detection chamber and the light detector may be configured to detect light scattered by the smoke. The light detector is preferably configured so as not to detect light from the light source when no smoke is present within the detection chamber.

Viewed from a third aspect, the present invention provides a computer program product or a tangible computer readable medium storing a computer program product, wherein the computer program product comprises computer executable instructions that when executed will cause a fire detector to perform a method as described above.

BRIEF DESCRIPTION OF THE DRAWINGS

A preferred embodiment of the present disclosure will now be described in greater detail, by way of example only and with reference to the accompanying figures, in which:

FIG. 1 shows a fire detector.

DETAILED DESCRIPTION

FIG. 1 shows a point-type fire detector 10 comprising a smoke sensor 12 and a multi-gas sensor 14. The smoke sensor 12 and the multi-gas sensor 14 are connected to a controller 16, which serves to control the operation of the fire detector 10.

The fire detector 10 is configured to be positioned within an environment 20 that it is desired to monitor, such as a room or space within a building. Ambient movement of air within the environment 20 causes air samples to be supplied to the fire detector 10, and the controller 16 uses the sensors 12, 14 to examine the air samples for indicators of fire within the environment 20.

In this embodiment, the fire detector 10 is configured to be connected, for example by a wired connection, to a fire control panel of a fire response system associated with the building. In the event of the detection of the presence of fire within the environment 20, the controller 16 sends an alert to the fire control panel, which may take appropriate action.

The fire response system may comprise one or more audible or visible alarm to alert occupants of the need to evacuate, which may be triggered in response to the detection of fire by the fire detector 10. The fire response system may further comprise one or more fire protection system and/or a fire suppression system, and one or more of these systems associated with the monitored environment 20 may be activated in responsive to the detection of fire by the fire system 10.

Those familiar with this field of technology will be well aware of the functionality and operation of such fire response systems, and these will therefore not be discussed in detail.

The controller 16 of the fire detector 10 detects the presence of fire within the monitored environment 20 by comparing a concentration of smoke detected by the smoke sensor 12 to a smoke threshold. If the concentration of smoke exceeds the smoke threshold, then the fire detector 10 sends the alert as described above. If the concentration of smoke does not exceed the smoke threshold, then no alert is sent.

The fire detector 10 is particularly designed for use within a dirty environment, such as a warehouse, a factory, an automotive parking facility or the like. These environments commonly include automotive vehicles or machinery comprising engines that burn fossil fuel and emit emissions that may contain smoke.

In order to reduce the risk of false alarms caused by these emissions, the gas sensor 14 is used to monitor for the presence of volatile organic compounds (VOCs) within the monitored environment 20. The presence of VOCs indicates the likely presence of emissions within the environment 20, and consequently the smoke sensitivity of the fire detector 10 is reduced in these situations.

In order to reduce the smoke sensitivity of the fire detector 10, the smoke threshold used by the controller 16 is increased. In one embodiment, when the total concentration of VOCs is below a VOC threshold, indicating low VOC levels, then the controller 16 will use a first, relatively low smoke threshold, and when the total concentration of VOCs is above the VOC threshold, indicating high VOC levels, then the controller 16 will use a second, relatively high smoke threshold.

By operating the controller in this manner 16, the fire detector 10 can still be operated in a high sensitivity mode when low VOC levels are detected, which provides an early indication of fire within the environment 20. However, the fire detector can nevertheless avoid, or at least reduce the number, of false alarms that might otherwise be caused by emissions within the environment 20.

Optionally, the controller may employ a plurality of different smoke thresholds, where the smoke threshold is progressively increased as the total concentration of VOCs increases past successively increasing VOC thresholds. In this way, the smoke sensitivity of the fire detector 10 changes in a more gradual manner within changing VOCs, thereby allowing increased smoke sensitivity when medium levels of VOCs are present, which would indicate the presence of somewhat increased smoke levels from emissions, but not necessarily high levels of smoke from emissions.

The smoke sensor 12 is an optical smoke sensor comprising a detection chamber, a light source and a light detector. Typically, the light source would be an infra-red (IR) LED or laser, and the light detector would be a photo-diode.

The smoke sensor 12 operates on a light scattering principle. The light source is configured to emit light into the detection chamber and the light detector is configured to detect light scattered by the smoke.

The fire detector 10 comprises a housing 18 provided within an optical labyrinth, which is configured to permit the flow of air into the detection chamber, but to prevent the direct transmission of light from the environment 20 into the detection chamber.

The gas sensor 14 is a metal oxide gas sensor, which is configured to detect the presence of various gases within air sampled from the monitored environment. In one embodiment, the gas sensor 14 may be an SGP30 sensor manufactured by Sensirion. The gas sensor 14 may be provided within the housing 18, for example within the detection chamber of the smoke sensor 12, but may alternatively be positioned outside of the housing 18 and exposed into the environment 20.

In various embodiments, the controller 16 may monitor the concentrations of one or more further components of the air sampled from the environment 20. These may include a concentration of CO2, a concentration of H2 and a concentration of PM2.5 particles. These concentrations may be indicative of air quality within the monitored environment 20.

The controller 16 may be configure to transmit environmental data to the fire control panel, or another system, where the environmental data comprises one or more of a total concentration of VOCs, a concentration of CO2, a concentration of H2 and a concentration of PM2.5 particles. This data may permit analysis of the air quality of the monitored environment. For example, if poor air quality is detected, a maintenance alert may be triggered to prompt a service provider to investigate the cause of the poor air quality within the monitored environment 20.

Advantageously, but utilising the environmental data collected by the gas sensor 14, it is possible to avoid the need for a separate environmental monitoring device within the monitored environment 20.

A further advantage of this type of gas sensor 14, is that it may additionally be operated to detect the presence of smoke. Indeed, it has been found that the gas sensor 14 has a higher sensitivity to smoke that many types of optical smoke detectors, such as used as the smoke sensor 12. Consequently, in some embodiments, the gas sensor 14 may be used to also detect the concentration of smoke within the monitored environment 20. This can either supplement the smoke detector 12, or indeed may be used as the smoke detector 12.

In one example, the gas sensor 14 may be used for the detection of smoke when low levels of VOC are present, i.e. when the fire detector 10 is operating at a high sensitivity, and the optical smoke sensor 12 may be used for the detection of smoke when high levels of VOC are present, i.e. when the fire detector 10 is operating at a low sensitivity.

Whilst a limited number of embodiments have been described, it will be appreciated that the techniques described herein may be applied to any type of fire detector 10. For example, the fire detector 10 is shown as a point-type detector, but the techniques described herein may also be applied to aspirating fire detectors. Furthermore, whilst the illustrated fire detector 10 is described as being for use with a fire response system of a building, the techniques described herein may also be applied to self-contained fire detectors having their own alarm system or where the fire detector directly triggers an external alarm system, fire suppression system or fire control system.

What is claimed is:

1. A fire detector (10) for monitoring an environment (20), the fire detector comprising a smoke sensor (12) and a volatile organic compound, VOC, sensor (14), wherein the fire detector is configured to adjust a smoke sensitivity of the fire detector based on a VOC concentration detected by the VOC sensor.

2. A fire detector (10) according to claim 1, wherein the fire detector is configured to take an action responsive to detection of a concentration of smoke exceeding a smoke threshold, wherein the smoke threshold is determined as a function of the VOC concentration detected by the VOC sensor (14).

3. A fire detector (10) according to claim 2, where the fire detector is configured such that a first, lower smoke threshold is used as the smoke threshold when a VOC concentration detected by the VOC sensor (14) is below a first VOC threshold, and a second, higher smoke threshold is used as the smoke threshold when the VOC concentration detected by the VOC sensor is above the first VOC threshold.

4. A fire detector (10) according to claim 2, wherein the action comprises sending an alert to a fire control panel.

5. A fire detector (10) according to claim 2, wherein the action comprises triggering a perceivable alarm or triggering a fire protection system and/or a fire suppression system associated with the monitored environment (20).

6. A fire detector (10) according to claim 1, wherein the VOC sensor (14) comprises a multi-gas sensor configured to detect environmental data comprising a concentration of at least one of PM2.5 particles, CO2 gas and H2 gas, and wherein the fire detector (10) is configured to send the environmental to an external system.

7. A fire detector (10) according to claim 1, wherein the fire detector is a point-type fire detector.

8. A fire response system comprising a fire detector (10) according to claim 1 and a fire control panel in communication with the fire detector.

9. A fire response system according to claim 8, wherein the fire detector (10) is one of a plurality of fire detectors, and wherein the fire response system further comprises one or more of an alarm, a fire protection system and a fire suppression system.

10. A method of operating a fire detector (10) comprising a smoke sensor (12) and a volatile organic compound, VOC, sensor (14), the method comprising:

monitoring a concentration of VOCs within an environment (20) using the VOC sensor; and adjusting a smoke sensitivity of the fire detector based on the VOC concentration.

11. A method according to claim 10, wherein the method comprises:

taking an action responsive to detection of a concentration of smoke exceeding a smoke threshold, wherein a first, lower smoke threshold is used as the smoke threshold when a VOC concentration detected by the VOC sensor (14) is below a first VOC threshold, and wherein a second, higher smoke threshold is used as the smoke threshold when the VOC concentration detected by the VOC sensor is above the first VOC threshold.

12. A method according to claim 11, wherein the action comprises one or more of:

triggering a perceivable alarm;

triggering a fire protection system and/or a fire suppression system; and sending an alert to a fire control panel.

13. A method according to claim 10, further comprising:

detecting environmental data using the VOC sensor (14), wherein the environment data comprises at least one of a concentration of PM2.5 particles, a concentration of CO2 gas and a concentration of H2 gas; and sending environment data to an external system separate from the fire detector.

14. A computer program product including a non-transitory computer readable medium, wherein the computer program product comprises computer executable instructions that when executed will cause a fire detector (10) to perform a method according to claim 10.

* * * * *